US007126281B2

(12) United States Patent
Grundmann et al.

(10) Patent No.: US 7,126,281 B2
(45) Date of Patent: Oct. 24, 2006

(54) HIGH-PRESSURE DISCHARGE LAMP FOR VEHICLE HEADLIGHTS

(75) Inventors: Dirk Grundmann, Berlin (DE); Conrad Schimke, Berlin (DE)

(73) Assignee: Patent-Treuhand-Gesellschaft für elektrishe Glühlampen mbH, Munich (DE)

( * ) Notice: Subject to any disclaimer, the term of this patent is extended or adjusted under 35 U.S.C. 154(b) by 270 days.

(21) Appl. No.: 10/798,848

(22) Filed: Mar. 12, 2004

(65) Prior Publication Data

US 2004/0183446 A1 Sep. 23, 2004

(30) Foreign Application Priority Data

Mar. 19, 2003 (DE) ..... 103 12 290

(51) Int. Cl.
*H01J 61/12* (2006.01)

(52) U.S. Cl. ..... 313/637

(58) Field of Classification Search ..... 313/637–638, 313/643

See application file for complete search history.

(56) References Cited

U.S. PATENT DOCUMENTS

| | | | | |
|---|---|---|---|---|
| 6,069,456 | A | 5/2000 | Fromm et al. | |
| 6,528,946 | B1 | 3/2003 | Ishigami et al. | |
| 2003/0222584 | A1 * | 12/2003 | Deguchi et al. | 313/638 |
| 2005/0093455 | A1 * | 5/2005 | Tamura et al. | 313/638 |

FOREIGN PATENT DOCUMENTS

| | | |
|---|---|---|
| EP | 0 883 160 | 12/1998 |
| EP | 0 903 770 | 3/1999 |

* cited by examiner

*Primary Examiner*—Joseph Williams
*Assistant Examiner*—Hana Sanei
(74) *Attorney, Agent, or Firm*—William E. Meyer

(57) ABSTRACT

The invention relates to a mercury-free high-pressure discharge lamp for use in a vehicle headlight. The ionizable filling of the high-pressure discharge lamp according to the invention comprises exclusively xenon and the halides of the metals sodium, scandium, indium and zinc.

6 Claims, 3 Drawing Sheets

HIGH-PRESSURE DISCHARGE LAMP FOR VEHICLE HEADLIGHTS

I. TECHNICAL FIELD

The invention relates to a high-pressure discharge lamp for vehicle headlights having a discharge vessel, which is sealed in a gas-tight manner, and in which are arranged two electrodes and an ionizable filling for producing a gas discharge. In particular, the invention relates to a metal-halide high-pressure discharge lamp for use as a light source in a vehicle headlight. Lamps of this type generally have an ionizable filling, which, in addition to mercury and xenon, contains halides of the metals sodium and scandium and, if required, also halides of further metals. Here, the mercury is not so much used for producing light, but rather, owing to its high vapor pressure, is primarily used for improving the electrical properties of these lamps, in particular for achieving an operating voltage in the range from 80 V to 110 V. Recently, attempts have been made to construct lamps of this type without using the environmentally-damaging mercury.

II. BACKGROUND ART

The European laid-open specification EP 0 903 770 A2 describes mercury-free halogen metal-vapor high-pressure discharge lamps, whose ionizable filling contains at least one volatile metal halide acting as a voltage-gradient former and further metal halides for producing light. The metal halides acting as voltage-gradient formers essentially perform the functions of the mercury in the mercury-free high-pressure discharge lamps. Halides of the metals Al, Bi, Hf, In, Mg, Sc, Sn, Tl, Zr, Zn, Sb or Ga are used as voltage-gradient formers. Halides of the metals Na, Pr, Nd, Ce, La, Dy, Ho, Tl, Sc, Hf, Zr or Tm primarily serve the purpose of producing light.

The European laid-open specification EP 0 883 160 A1 discloses mercury-free halogen metal-vapor high-pressure discharge lamps whose ionizable filling contains an inert gas, a first metal halide for producing light and a second metal halide which acts as the buffer gas and has a high vapor pressure. Halides of the metals iron, cobalt, chromium, zinc, nickel, manganese, aluminum, antimony, beryllium, rhenium, gallium, titanium, zirconium or hafnium can be used as the buffer gas.

III. DISCLOSURE OF THE INVENTION

It is the object of the invention to provide a mercury-free high-pressure discharge lamp which is suitable as a light source for a vehicle headlight.

This object is achieved by a high-pressure discharge lamp having a discharge vessel, which is sealed in a gas-tight manner, and in which are arranged two electrodes and an ionizable filling for producing a gas discharge, wherein the ionizable filling comprises xenon and halides of the metals sodium, scandium, indium and zinc.

The high-pressure discharge lamp according to the invention has a discharge vessel, which is sealed in a gas-tight manner, and in which are arranged two electrodes and an ionizable filling for producing a gas discharge, the ionizable filling comprising xenon and halides of the metals sodium, scandium, indium and zinc. It has been shown that by using exclusively the abovementioned filling components a high-pressure discharge lamp can be constructed which has sufficiently good color rendering and luminous efficiency and a sufficiently long service life for use as a light source in a vehicle headlight. The means described in the prior art for increasing the operating voltage to the values which are usual for mercury-containing lamps of between 80 volts and 110 volts are not required. Instead, the high-pressure discharge lamp according to the invention has an operating voltage of only 45 volts. With the filling components according to the invention it is possible to achieve a color rendering of Ra=65, a color temperature of approximately 4000 K, a luminous efficiency of 85 lm/W, and a service life of more than 3000 hours. The halides are advantageously iodides or bromides and not fluorides, since the latter may only be used in conjunction with a ceramic discharge vessel. Particularly preferred are the iodides of the abovementioned metals, since they are chemically less aggressive than the bromides and usually have a higher vapor pressure. In particular, the iodides of the abovementioned metals are also suitable for high-pressure discharge lamps having a silica-glass discharge vessel. Discharge vessels made of a transparent ceramic such as, for example, polycrystalline aluminum oxide, sapphire or aluminum nitride are not necessarily required.

For a high-pressure discharge lamp, whose discharge vessel has a volume in the range from 23 $mm^3$ to 30 $mm^3$, an ionizable filling is advantageously used which comprises the following components:

xenon having a cold filling pressure, that is the pressure at room temperature (22° C.), of at least 9000 hPa, preferably even at least 11000 hPa and at most 13000 hPa, at least 0.15 mg and at most 0.30 mg of sodium iodide, at least 0.10 mg and at most 0.25 mg of scandium iodide, a maximum of 0:10 mg, but preferably no more than 0.05 mg, of zinc iodide and a maximum of 0.05 mg of indium iodide.

By suitable selection of the cold filling pressure of the xenon and the zinc iodide content, the operating voltage of the lamp, that is the voltage drop across the lamp when the lamp is in almost steady-state operation, i.e. once the gas discharge in the discharge vessel has been started and stabilized, is set to a constant value, preferably to 45 volts. In addition, xenon plays a significant role in increasing the efficiency of the light production in the gas discharge. The cold filling pressure of the xenon should therefore be at least 9000 hPa, preferably even at least 11000 hPa, in order to achieve a high luminous flux and thus a high luminous efficiency. As can be seen from FIG. 2, there is a linear relationship between the cold filling pressure of the xenon and the luminous efficiency. With a cold filling pressure of 9000 hPa, the luminous flux is 2982 lm and the luminous efficiency is 85 lm/W, and with a cold filling pressure of 11000 hPa, the luminous flux is increased to 3112 lm and the luminous efficiency is improved even to 89 lm/W. According to the illustration in FIG. 2, a cold filling pressure of the xenon which is as high as possible would be desirable. The discharge vessel would also withstand a xenon cold filling pressure of more than 20000 hPa, but if a xenon cold filling pressure of 13000 hPa were to be exceeded, both the operating voltage of the lamp and the color temperature of the light produced in the gas discharge would be altered. In order to reset the color temperature to the desired value, preferably 4000 K, the content of scandium iodide would have to be increased. However, this could lead to the discharge vessel, which is preferably made of silica glass, being damaged, since scandium reacts chemically with quartz. In order, at a relatively high xenon cold filling pressure, to set the operating voltage of the lamp to a predetermined value, preferably 45 volts, the content of zinc iodide is advantageously selected correspondingly. The content of zinc iodide is advantageously less than or equal to 0.10 mg and preferably even less than or equal to 0.05 mg. In the pressure range of the xenon cold filling pressure of 9000 hPa to 13000 hPa the content by weight of zinc iodide is advantageously selected such that the linear relationship $Y=-1.5\times10^{-5}(X)+0.207$ is approximately satisfied, the variable Y in the abovementioned equation being the numerical value of the zinc iodide content in milligrams [mg], and X being the numerical value of the xenon cold filling pressure in hectopascals [hPa] (FIG. 3). In addition to the abovementioned filling components, sodium iodide, scandium iodide and indium iodide are also used for light production in the high-pressure discharge lamps according to the invention. The abovementioned quantity ranges for these filling components are determined by the desired color temperature, preferably 4000 K, and the desired color location of the light produced by the gas discharge. It is necessary to add a comparatively small quantity of indium iodide to produce white light in accordance with the ECE regulation R.99. As shown in FIG. 4, the color location of the filling in accordance with the preferred exemplary embodiment is within the trapezoid illustrated in FIG. 4, which defines the color locations of white light which are permissible for light sources of vehicle headlights in accordance with the ECE regulation R.99. If indium iodide were to be dispensed with, although a color temperature of 4000 K may also be achieved, the color location of the light would be outside the trapezoid illustrated in FIG. 4, and the lamp would therefore no longer be suitable as a vehicle headlamp. In order to keep both the color location and the color temperature in the desired range, the molar ratio of sodium to scandium in the ionizable filling of the lamp according to the invention advantageously has a value of between 3 and 6.

The electrodes of the high-pressure discharge lamps according to the invention advantageously have a thickness or a diameter in the range from 0.27 mm to 0.36 mm, in order to be able to carry a sufficiently high current. As has already been mentioned above, the high-pressure discharge lamps according to the invention have a low operating voltage U in comparison with the prior art. In order to ensure the same power consumption level, generally 35 watts, as conventional, mercury-containing high-pressure discharge lamps, the high-pressure discharge lamps according to the invention have correspondingly thicker electrodes, which have a correspondingly higher current-carrying capacity. The distance between the electrodes is advantageously less than 5 mm, in order to be able to project the discharge arc more effectively by means of the optical systems in the vehicle headlight.

IV. BRIEF DESCRIPTION OF THE DRAWINGS

The invention is explained in more detail below with reference to a preferred exemplary embodiment. In the drawing:

FIG. 1 shows a schematic representation of a side view of a high-pressure discharge lamp in accordance with the preferred exemplary embodiment of the invention, FIG. 2 shows the luminous flux as a function of the xenon cold filling pressure in the high-pressure discharge lamps according to the invention having the metal-halide filling in accordance with the preferred exemplary embodiment. Plotted on the vertical axis is the luminous flux in lumens, and plotted on the horizontal axis is the xenon cold filling pressure in hectopascals.

V. BEST MODE FOR CARRYING OUT THE INVENTION

Figure 1:
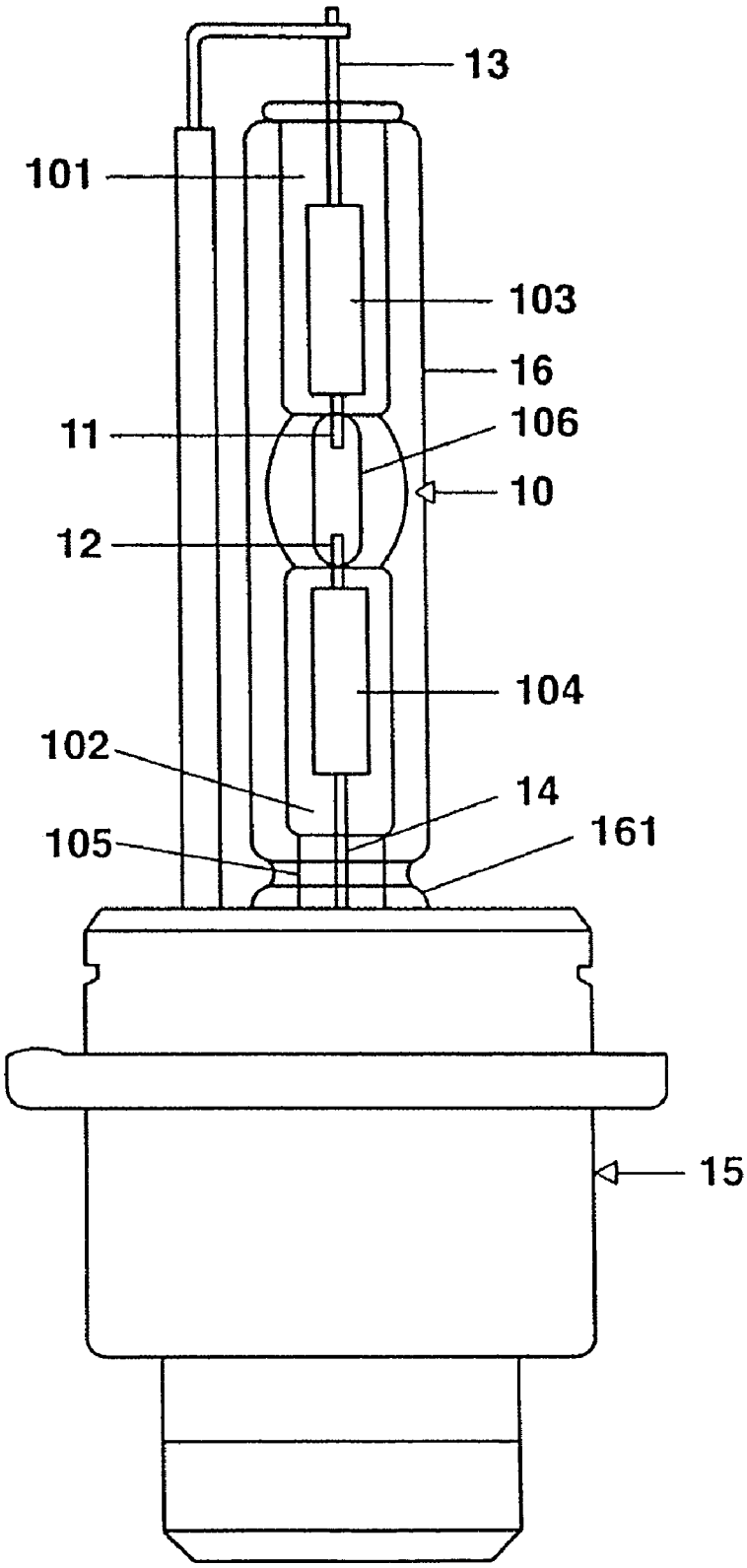
Figure 2:
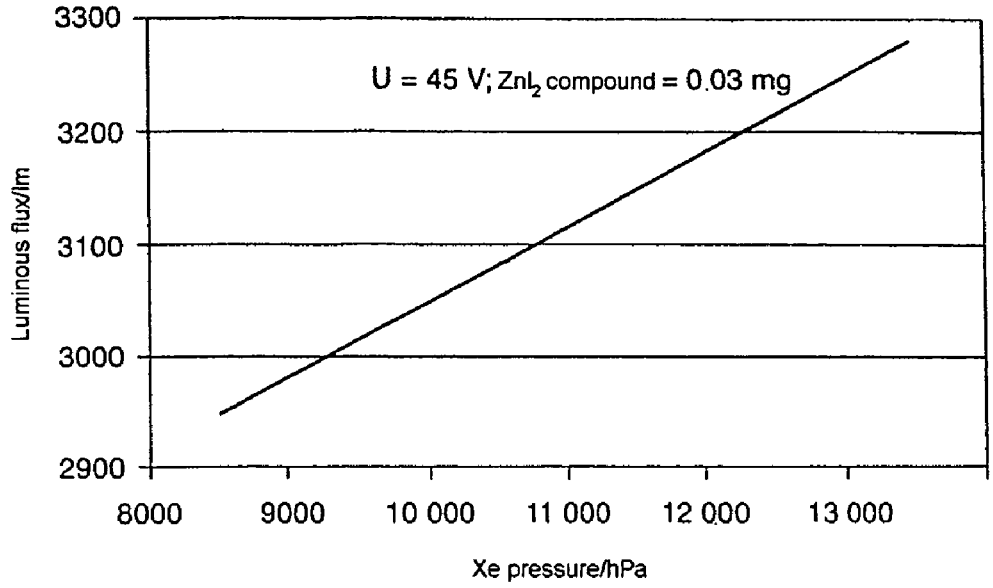
Figure 3:
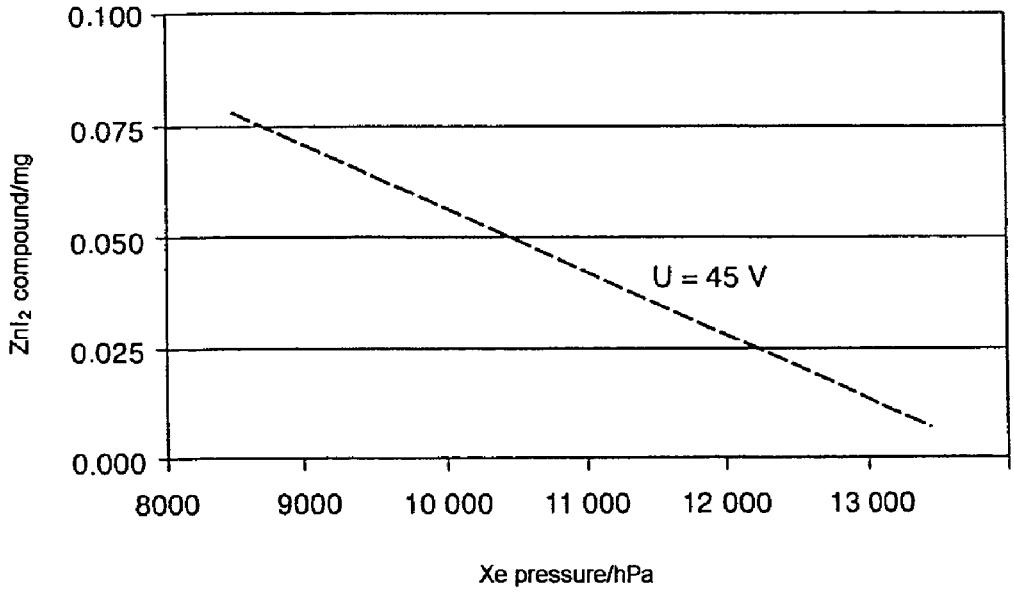
FIG. 3 shows the relationship between the xenon cold filling pressure and the content of zinc iodide in the high-pressure discharge lamps according to the invention. Plotted on the vertical axis is the content of zinc iodide in the filling in milligrams, and plotted on the horizontal axis is the xenon cold filling pressure in hectopascals.
Figure 4:
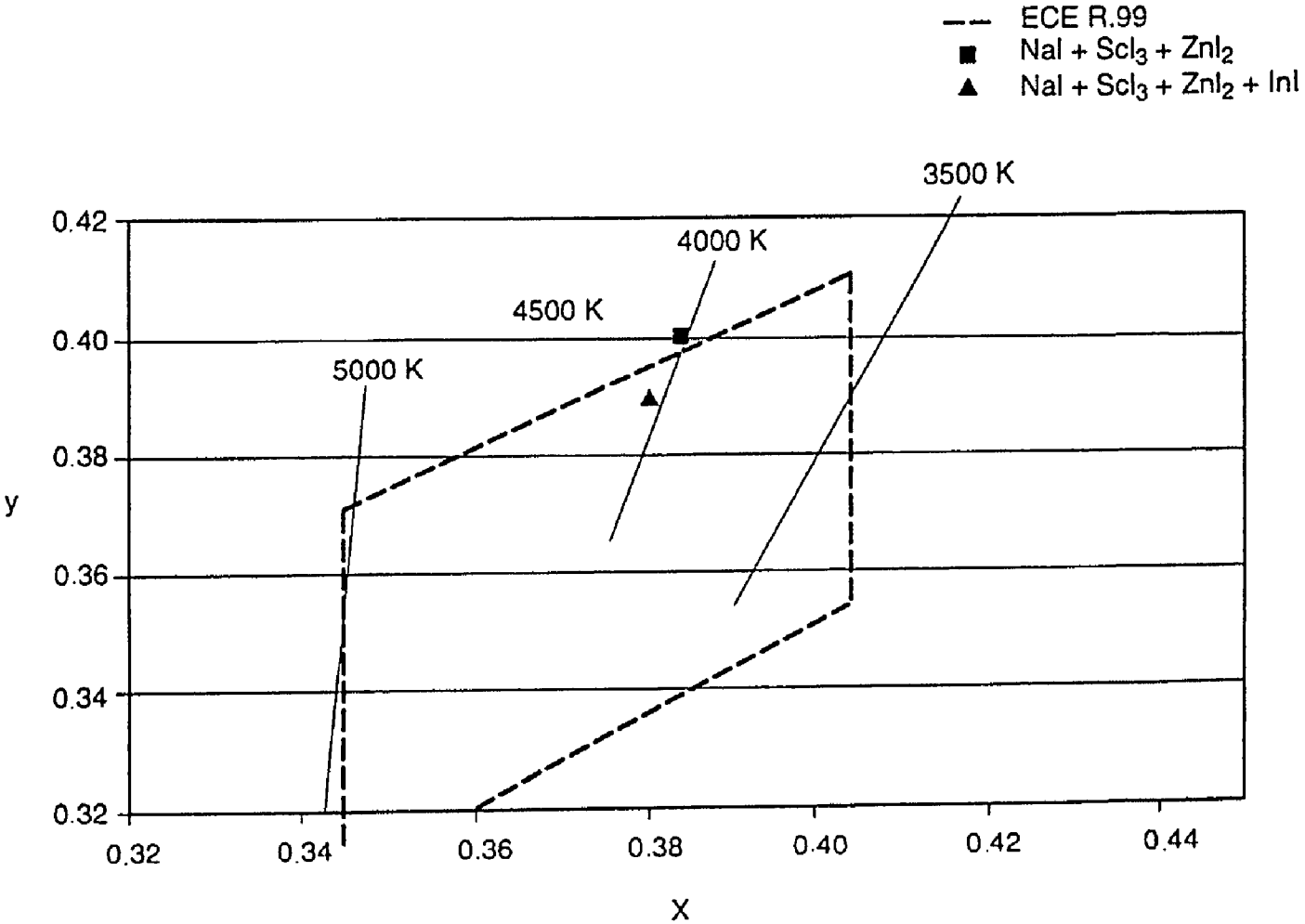
FIG. 4 shows the color location and the color temperature of the high-pressure discharge lamps according to the invention in comparison with high-pressure discharge lamps without indium iodide.

The preferred exemplary embodiment of the invention is a mercury-free halogen metal-vapor high-pressure discharge lamp having an electrical power consumption of approximately 35 watts. This lamp is intended for use in a vehicle headlight. It has a silica-glass discharge vessel 30, which is sealed off at two ends, which has a volume of 24 $mm^3$, and in which an ionizable filling is enclosed in a gas-tight manner. In the region of the discharge space 106, the inner contour of the discharge vessel 30 is in the form of a circular cylinder, and its outer contour is ellipsoidal. The inner diameter of the discharge space 106 is 2.6 mm, and its outer diameter is 6.3 mm. The two ends 101, 102 of the discharge vessel 10 are each sealed off by means of a molybdenum foil seal 103, 104. Within the discharge vessel 10 are two electrodes 11, 12, between which, during lamp operation, the discharge arc responsible for the light emission is formed. The electrodes 11, 12 are made of tungsten. Their thickness or their diameter is 0.30 mm. The distance between the electrodes 11, 12 is 4.2 mm. The electrodes 11, 12 are each electrically conductively connected to an electrical connection of the lamp base 15, which is essentially made of plastic, via one of the molybdenum foil seals 103, 104 and via the power supply line 13 which is remote from the base or via the base-side power return line 14. The discharge vessel 10 is surrounded by a glass outer bulb 16. The outer bulb 16 has a protrusion 161 which is anchored in the base 15. The discharge vessel 10 has, on the base side, a silica-glass, tubular extension 105, in which the base-side power supply line 14 runs.

The ionizable filling enclosed in the discharge vessel comprises xenon having a cold filling pressure of 11800 hPa, 0.25 mg of sodium iodide, 0.18 mg of scandium iodide, 0.03 mg of zinc iodide and 0.0024 mg of indium iodide. The operating voltage U of the lamp is 45 volts. Its color temperature is 4000 kelvin, its color location is, in the standardized chromaticity diagram according to DIN 5033, at the color coordinates x=0.383 and y=0.389. Its color rendering index is 65, and its light efficiency is 90 lm/W.

What is claimed is:

1. A high-pressure discharge lamp for vehicle headlights having a discharge vessel, which is sealed in a gas-tight manner, and in which are arranged two electrodes and an ionizable filling for producing a gas discharge, wherein the ionizable filling comprises xenon and halides of the metals sodium, scandium, indium and zinc, the concentration of sodium iodide ranges from 0.0083 to 0.0109 $mg/mm^3$;

the concentration of scandium iodide ranges from 0.0060 to 0.0078 $mg/mm^3$;

the concentration of zinc iodide ranges from 0.0010 to 0.0013 $mg/mm^3$; and the concentration of indium iodide is about 0.000 1 $mg/mm^3$.

2. The high-pressure discharge lamp as claimed in claim 1, wherein the halides are iodides.

3. The high-pressure discharge lamp as claimed in claim 2, wherein the volume of the discharge vessel has a value in the range from 23 $mm^3$ to 30 $mm^3$, and the cold filling pressure of xenon has a value in the range from 9000 hPa to 13000 hPa.

4. The high-pressure discharge lamp as claimed in claim 2, wherein the thickness or the diameter of the electrodes has a value in the range from 0.27 mm to 0.36 mm, and the distance between the electrodes is less than 5 mm.

5. The high-pressure discharge lamp as claimed in claim 2, wherein the high-pressure discharge lamp has an outer bulb (16) which surrounds the discharge vessel (10), the discharge vessel (10) is made of silica glass and has a volume in the range from 23 $mm^3$ to 30 $mm^3$, the thickness or the diameter of the electrodes (11, 12) has a value in the range from 0.27 mm to 0.36 mm, the distance between the electrodes (11, 12) is less than 5 mm, and the cold filling pressure of xenon has a value in the range from 9000 hPa to 13000 hPa.

6. The high-pressure discharge lamp as claimed in claim 2, wherein:

$$Y=-1.5\times10^5X+0.207$$

where X is the numerical value of the cold filling pressure of xenon in hPa, and Y is the content by weight of zinc iodide in mg.

* * * * *